US008646904B2

(12) United States Patent
Sakano

(10) Patent No.: US 8,646,904 B2
(45) Date of Patent: Feb. 11, 2014

(54) SHEET FEEDING DEVICE AND RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 172 days.

(21) Appl. No.: 13/076,074

(22) Filed: Mar. 30, 2011

(65) Prior Publication Data

US 2011/0267412 A1 Nov. 3, 2011

(30) Foreign Application Priority Data

Apr. 28, 2010 (JP) ..... 2010-103028

(51) Int. Cl.
*B41J 2/01* (2006.01)
*B65H 5/06* (2006.01)

(52) U.S. Cl.
USPC ..... 347/104; 271/4.1

(58) Field of Classification Search
USPC ..... 347/101, 104, 108, 109; 271/4.1; 400/578; 475/5, 149, 207, 331
IPC ..... B41J 2/01; B65H 5/06
See application file for complete search history.

(56) References Cited

U.S. PATENT DOCUMENTS

| | | | | |
|---|---|---|---|---|
| 6,059,281 | A * | 5/2000 | Nakamura et al. | 271/119 |
| 2002/0074712 | A1* | 6/2002 | Yano | 271/121 |
| 2004/0012143 | A1* | 1/2004 | Yamamoto | 271/272 |
| 2004/0017037 | A1* | 1/2004 | Kawakami et al. | 271/114 |
| 2004/0109056 | A1* | 6/2004 | Kang | 347/104 |
| 2006/0181015 | A1 | 8/2006 | Takahashi | |
| 2009/0295075 | A1* | 12/2009 | Inoue | 271/226 |
| 2010/0032893 | A1* | 2/2010 | Koga et al. | 271/110 |
| 2010/0067968 | A1* | 3/2010 | Mizutani | 400/611 |

FOREIGN PATENT DOCUMENTS

| | | | |
|---|---|---|---|
| JP | H06-183600 | A | 7/1994 |
| JP | H07-137872 | A | 5/1995 |
| JP | H10-245131 | A | 9/1998 |
| JP | 2004-240376 | A | 8/2004 |

OTHER PUBLICATIONS

Japan Patent Office, Notification of Reasons for Refusal for Japanese Patent Application No. 2010-103028 (counterpart to above-captioned patent application), dispatched Jun. 12, 2012.

The State Intellectual Property Office of the People's Republic of China, Notification of First Office Action for Chinese Patent Application No. 201110084145.0 (counterpart Chinese patent application), issued Mar. 13, 2013.

* cited by examiner

*Primary Examiner* — Manish S Shah
*Assistant Examiner* — Roger W Pisha, II
(74) *Attorney, Agent, or Firm* — Baker Botts L.L.P.

(57) ABSTRACT

A sheet feeding device, including: a sheet cassette configured to accommodate sheets; a conveyance path through which each of the sheets accommodated in the sheet cassette is conveyed; a rotation roller provided at one of a start point and a vicinity thereof in the conveyance path; a motor configured to rotatably drive the rotation roller; a pressure body configured to come into pressing contact with the rotation roller via the sheet; and a moving mechanism configured to separate the rotation roller and the pressure body, which are in pressing contact with each other, away from each other in dependence on drive stop of the motor.

17 Claims, 8 Drawing Sheets

SHEET FEEDING DEVICE AND RECORDING APPARATUS

CROSS REFERENCE TO RELATED APPLICATION

The present application claims priority from Japanese Patent Application No. 2010-103028, which was filed on Apr. 28, 2010, the disclosure of which is herein incorporated by reference in its entirety.

BACKGROUND OF THE INVENTION

1. Field of the Invention

The present invention relates to a sheet feeding device provided in a recording apparatus such as a facsimile machine, a copying machine, or a printer. More specifically, the invention relates to such a sheet feeding device removably equipped with a sheet cassette in which recording sheets are accommodated, wherein paper jamming is prevented at a time when the sheet cassette is taken out of a main body of the apparatus.

2. Discussion of Related Art

A general recording apparatus such as a facsimile machine, a copying machine or a printer conventionally includes a recording device configured to record an image on a recording sheet, a sheet feeding device configured to feed the recording sheets one by one from a sheet cassette to the recording device, and a sheet discharging device configured to discharge the recording sheet from the recording device. As such a sheet feeding device, there is known one including: a sheet cassette which accommodates the recording sheets; a sheet-supply conveyance path through which each recording sheet is conveyed from the sheet cassette to the recording device; a pickup roller; a feed roller disposed downstream of the pickup roller on the conveyance path; and a separation roller which forms a pair with the feed roller. The pickup roller is configured to come into pressing contact with an uppermost one of the recording sheets accommodated so as to be stacked on the sheet cassette. The separation roller is configured to come into pressing contact with the feed roller. Further, the feed roller is configured to rotate so as to feed each of the recording sheets in a sheet feed direction along the conveyance path while the separation roller is configured to rotate so as to send the recording sheet back in a direction opposite to the sheet feed direction. In the thus constructed sheet feeding device, each of the recording sheets accommodated in the sheet cassette is sent to the conveyance path by the rotation of the pickup roller, and one recording sheet separated from the other sheets by the rotations of the feed roller and the separation roller is fed in the sheet feed direction along the conveyance path.

In the sheet feeding device described above, the sheet cassette is generally disposed in the main body of the recording apparatus so as to be attachable to and detachable from the main body. In replenishing the sheet cassette with the recording sheets, the sheet cassette installed in the main body of the recording apparatus is once taken out of the main body, and the sheet cassette is inserted back into the main body after the recording sheets have been accommodated in the sheet cassette for replenishment. In a general sheet feeding device, the direction in which the sheet cassette is moved at a time when the sheet cassette is taken out of the main body is orthogonal to a direction in which the recording sheet is sent from the sheet cassette by the pickup roller. Accordingly, where the recording sheet is receiving a pressure from the pickup roller, the feed roller or the separation roller at a time when the sheet cassette is taken out of the main body, a part of the recording sheet that is receiving the pressure from the roller may be torn as a result of failure to follow the movement of the sheet cassette or the recording sheet may remain in the main body to cause a malfunction of the apparatus. In view of this, there is proposed a structure in which the pickup roller and the separation roller are separated away from the recording sheet at a time when the sheet cassette is taken out of the main body, as disclosed in the following Patent Literature 1.

As a sheet feeding device having the structure described above, there is known a sheet feeding device in which cutting off a current supply to a solenoid triggers the separation roller to separate away from the feed roller. The disclosed sheet feeding device is equipped with a pressure release solenoid configured to move the separation roller. When the apparatus is operating, the current supply to the pressure release solenoid is turned on, whereby the separation roller is brought into pressing contact with the feed roller. When the apparatus stops operating, the current supply to the solenoid is turned off, whereby the separation roller is controlled to be separated away from the feed roller.

SUMMARY OF THE INVENTION

Where the current supply to the solenoid triggers the separation roller to separate away from the feed roller as described above, the recording sheet is not subjected to a pressure acting from these rollers when the sheet cassette is taken out of the main body of the apparatus. However, the solenoid is relatively expensive. Further, it is necessary to control the solenoid.

It is therefore an object of the invention to provide a sheet feeding device in which, when the sheet cassette is taken out of the main body, the pressure from the rollers with respect to the recording sheet is released without using the solenoid.

The above-indicated object may be attained according to a principle of the invention, which provides a sheet feeding device, comprising:

- a sheet cassette configured to accommodate sheets;
- a conveyance path through which each of the sheets accommodated in the sheet cassette is conveyed;
- a rotation roller provided at one of a start point and a vicinity thereof in the conveyance path;
- a motor configured to rotatably drive the rotation roller;
- a pressure body configured to come into pressing contact with the rotation roller via the sheet; and
- a moving mechanism configured to separate the rotation roller and the pressure body, which are in pressing contact with each other, away from each other in dependence on drive stop of the motor.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which:

FIGS. 7A and 7B are front views each schematically showing a mechanism of moving a pickup roller and the retard roller for explaining states thereof before and after the movement, FIG. 7A showing the state of the rollers at a time of drive stop of the sheet feed motor while FIG. 7B shows the state of the rollers at a time of drive of the sheet feed motor.

DETAILED DESCRIPTION OF THE EMBODIMENT

There will be described one embodiment of the invention with reference to the drawings. A sheet feeding device according to the embodiment of the invention is provided, as a sheet feeding portion, in an ink-jet recording apparatus as one example of a recording apparatus. The ink-jet recording apparatus includes four line-type recording heads for respectively ejecting a black ink, a cyan ink, a magenta ink, and a yellow ink to perform color printing. In the following description, the same reference numbers are assigned to components which are identical or equivalent through all of the drawings and an explanation thereof is not repeated.

[General Structure of Ink-Jet Recording Apparatus 1]

Figure 1:
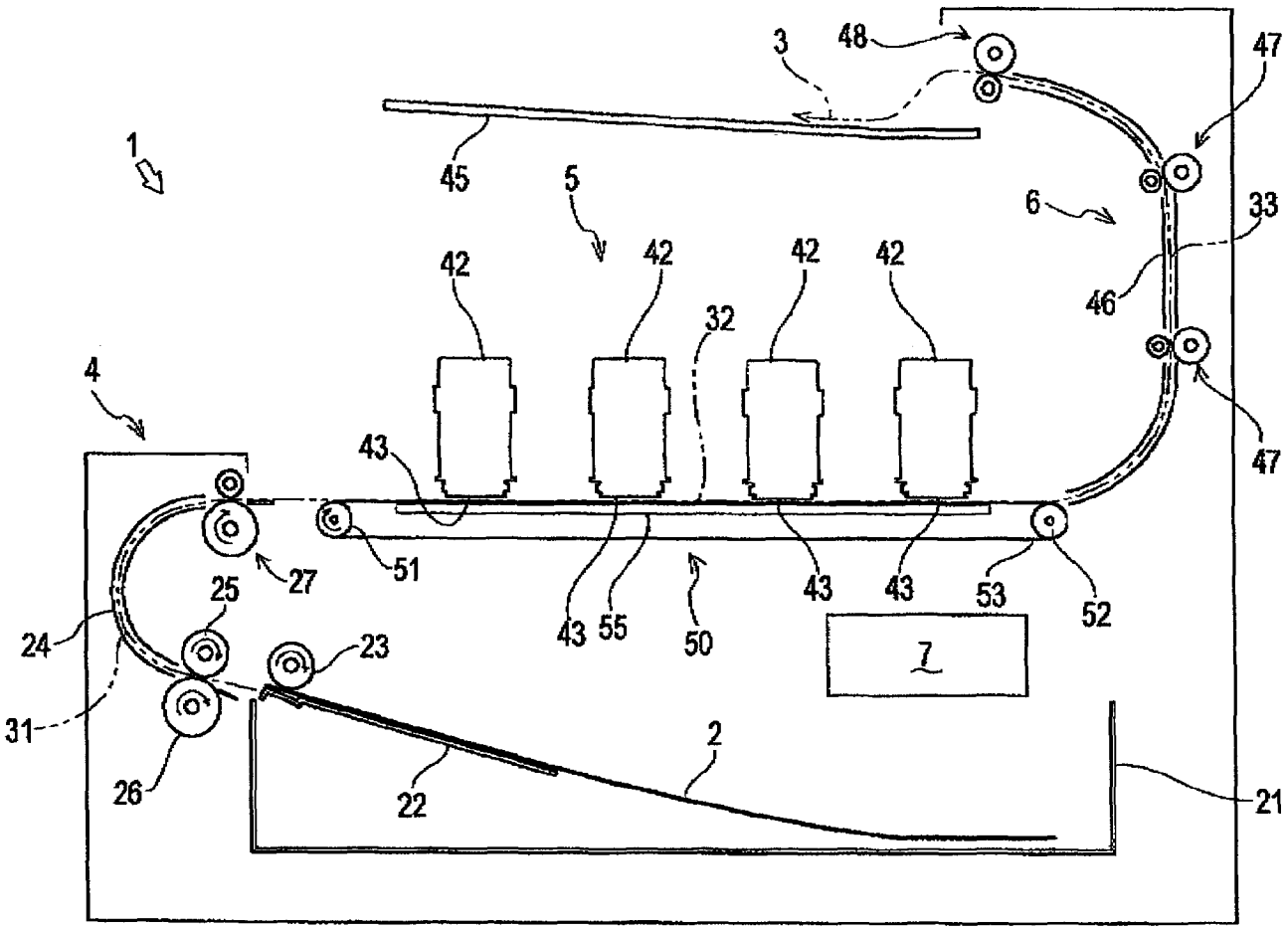
FIG. 1 is a front view schematically showing an overall structure of an ink-jet recording apparatus according to one embodiment of the invention.

Referring first to FIG. 1, there will be explained a general structure of the ink-jet recording apparatus indicated at 1 in FIG. 1. FIG. 1 schematically shows an internal structure of the ink-jet recording apparatus 1. In FIG. 1, a part of constituent components including a sheet cassette 21 and so on are illustrated in cross section for the sake of convenience, but hatching indicative of the cross section is omitted. The ink-jet recording apparatus 1 includes: a recording portion 5 for conducting a recording operation on a recording sheet 2 as a recording medium; a sheet feeding portion 4 for feeding the recording sheet 2 to the recording portion 5; a sheet discharging portion 6 for discharging the recording sheet 2 from the recording portion 5; and a controller 7 for controlling operations of those portions. In the ink-jet recording apparatus 1, there is formed a conveyance path 3 constituted by: a sheet feed path 81 provided in the sheet feed portion 4; a record path 32 provided in the recording portion 5; and a sheet discharge path 33 provided in the sheet discharging portion 6. In FIG. 1, the conveyance path 3 is illustrated by a long dashed double-short dashed line. In the ink-jet recording apparatus 1, the recording operation is performed on the recording sheet 2 conveyed through the conveyance path 3. Hereinafter, the sheet feeding portion 4, the recording portion 5, and the sheet discharging portion 6 will be explained in detail.

The sheet feeding portion 4 includes the sheet cassette 21 in which the recording sheets 2 are accommodated and the sheet feed path 81 through which each recording sheet 2 is fed from the sheet cassette 21 to the recording portion 5. The sheet cassette 21 is removably attached to a main body of the ink-jet recording apparatus L When the sheet cassette 21 is taken out of the main body, the sheet cassette 21 is moved or pulled out in a direction perpendicular to the sheet plane of FIG. 1. The recording sheets 2 are accommodated in the sheet cassette 21 so as to be stacked in the vertical direction, and each of the recording sheets 2 is sent to the sheet feed path 31 from the sheet cassette 21. On one side of the sheet cassette 21 (on the left side in FIG. 1), an upstream end of the sheet feed path 31 is located. A plate-like sheet feed guide 22 is provided in the sheet cassette 21 so as to be connected to the upstream end of the sheet feed path 31. There is provided, above the sheet feed guide 22, a pickup roller 23 having a circumferential surface that is opposed to the sheet feed guide 22. The pickup roller 23 is movable toward and away from the sheet feed guide 22. When the ink-jet recording apparatus 1 is operating, the pickup roller 23 is located close to the sheet feed guide 22, and the circumferential surface of the pickup roller 23 is held in pressing contact with a portion of an uppermost one of the recording sheets 2 accommodated in the sheet cassette 21, which portion is located on the sheet feed guide 22. When the pickup roller 23 rotates in this state, the recording sheet 2 held by and between the pickup roller 23 and the sheet feed guide 22 is sent from the sheet cassette 21 to the sheet feed path 31.

The sheet feed path 31 is constituted by a plurality of feed-side guides 24 and a plurality of rollers for feeding the recording sheet 2 along the feed-side guides 24. In the present embodiment, the recording portion 5 is disposed right above the sheet cassette 21, and the sheet feed path 31 is formed into an arcuate shape in side view by the feed-side guides 24, so as to extend from the sheet cassette 21 toward the recording portion 5.

At an upstream portion of the sheet feed path 31, a pair of rollers 25, 26 are disposed such that circumferential surfaces of the respective rollers 25, 26 are opposed to each other with the sheet feed path 31 interposed therebetween. One 25 of the pair of rollers is a feed roller 25 and the other 26 is a retard roller 26. The recording sheet 2 on the sheet feed path 31 is held by and between the circumferential surface of the feed roller 25 that is being rotated and the circumferential surface of the retard roller 26 that is being rotated, and is fed in a sheet feed direction, namely, toward the downstream side in the sheet feed path 31. In this instance, the feed roller 25 rotates so as to feed the recording sheet 2 in the sheet feed direction while the retard roller 26 rotates so as to send the recording sheet 2 back in a direction opposite to the sheet feed direction. Owing to the action of the pair of rollers 25, 26, even where a plurality of recording sheets 2 are sent from the sheet cassette 21, only one of the recording sheets 2 is separated from the other recording sheets 2 and is fed in the sheet feed direction.

At a downstream portion of the sheet feed path 31, a register roller pair 27 is disposed such that circumferential surface of the rollers of the register roller pair 27 are opposed to each other with the sheet feed path 31 interposed therebetween. The recording sheet 2 is fed in the sheet feed direction while being held by and between the circumferential surfaces of the respective rollers of the register roller pair 27 being rotated, whereby the recording sheet 2 is fed to the record path 32 with an appropriate posture and an appropriate orientation.

The recording portion 5 includes: the record path 32 connected to a downstream end of the sheet feed path 31 of the sheet feeding portion 4; and the plurality of recording heads 42 provided in the record path 32.

The record path 32 is constituted by a belt conveyor 50. The belt conveyor 50 includes: a drive roller 51 and a driven roller 52 disposed such that respective rotation axes are located so as to be away from each other in a direction of extension of the record path 32; an endless belt 53 wound around the rollers 51, 52; and a motor (not shown) configured to rotatavely drive the drive roller 51. The upper surface of the endless belt 53 functions as a conveyor surface on which each recording sheet 2 is conveyed. A portion of the conveyor surface between the drive roller 51 and the driven roller 52 defines the record path 32. In order to maintain the horizontalness of the conveyor surface, there is provided a platen 55 which supports the endless belt 53 from the underside between the drive roller 51 and the driven roller 52.

The recording heads 42 are disposed above the conveyor surface of the record path 32. The present ink-jet recording apparatus 1 includes the four recording heads 42 which are arranged in a conveyance direction such that the head 42 for ejecting the black ink, the head 42 for ejecting the cyan ink, the head 42 for ejecting the magenta ink, and the head 42 for ejecting the yellow ink are arranged in this order from the upstream side in the record path 32. Each recording head 42 has an ejection surface 43 facing the conveyor surface. Ejection openings of a plurality of nozzles of each recording head 42 are open in the ejection surface 43, and ink droplets are selectively ejected from the ejection openings toward the recording sheet 2 conveyed on the conveyor surface. The ejected ink droplets are attached to a recording surface of the recording sheet 2 so as to form an image or the like on the recording sheet 2. Thus, the recording operation is conducted.

The sheet discharging portion 6 includes a discharge tray 45 and the sheet discharge path 33 that is connected to a downstream end of the record path 32. The recording sheet 2 transferred from the record path 32 to the sheet discharge path 33 is discharged to the discharge tray 45 through the sheet discharge path 33. The sheet discharge path 33 is constituted by a plurality of output-side guides 46, a plurality of delivery roller pairs 47 configured to deliver the recording sheet 2 along the output-side guides 46, and a discharge roller pair 48 configured to discharge, to the discharge tray 45, the recording sheet 2 delivered through the sheet discharge path 33. In the present embodiment, the discharge tray 45 is disposed above the recording portion 5, and the sheet discharge path 33 is formed into an arcuate shape in side view by the output-side guides 46, so as to extend from the downstream end of the record path 32 toward the discharge tray 45.

In the thus constructed ink-jet recording apparatus 1, the sheet feeding portion 4 is configured such that each of the recording sheets 2 accommodated in the sheet cassette 21 is drawn out of the sheet cassette 21 and is fed to the recording portion 5 along the sheet feed path 31. The recording portion 5 is configured such that the recording sheet 2 fed from the sheet feeding portion 4 is conveyed on the record path 32 and the recording operation is conducted by ejecting the ink to the recording sheet 2 that is being conveyed. The sheet discharging portion 6 is configured such that the recording sheet 2 which has been subjected to the recording operation is delivered to the discharge tray 45 along the sheet discharge path 33. A series of the operation of the ink-jet recording apparatus 1 described above is controlled by the controller 7.

[Structure of Rollers of Sheet Feeding Portion 4]

Referring next to FIGS. 2-5, the sheet feeding portion 4 will be explained in detail. The sheet feeding portion 4 includes a plurality rollers configured to rotate, i.e., the pickup roller 23, the feed roller 25, the retard roller 26, and the register roller pair 27. These rollers are rotatatively driven by one sheet feed motor 60. Hereinafter, the structures of the pickup roller 23, the feed roller 25, and the retard roller 26 will be explained.

There will be first explained a force transmission structure from the sheet feed motor 60 to the pickup roller 23, the feed roller 25, and the retard roller 26. The rotational force or torque outputted from the sheet feed motor 60 is transmitted to a feed-roller shaft 71 via a force transmission path constituted by a plurality of gears. More specifically, the rotational force is transmitted from an output gear 60*a* provided on an output shaft of the sheet feed motor 60 to the feed-roller shaft 71 via a first idle gear 61, a second idle gear 62, a third idle gear 63, and a first drive gear 64. The first idle gear 61 is constituted by a large-diameter gear 61*a* and a small-diameter gear 61*b* which have mutually different diameters. The large-diameter gear 61*a* is in mesh with the output gear 60*a* while the small-diameter gear 61*b* is in mesh with the second idle gear 62. The third idle gear 63 is constituted by a small-diameter gear 63*a* and a large-diameter gear 63*b* which have mutually different diameters. The small-diameter gear 63*a* is in mesh with the second idle gear 62 while the large-diameter gear 63*b* is in mesh with the first drive gear 64. The output gear 60*a* of the sheet feed motor 60 is configured to rotate clockwise in FIG. 4 (i.e., to rotate forward), and the feed-roller shaft 71 rotates forward by the rotational force transmitted from the output gear 60*a* via the plurality of gears.

In the force transmission path from the first drive gear 64 to the feed-roller shaft 71, an electromagnetic clutch 81 is provided. The electromagnetic clutch 81 is controlled by the controller 7 so as to switch force transmission from the first drive gear 64 to the feed-roller shaft 71 between on and off. More specifically, the electromagnetic clutch 81 is configured to form the force transmission path from the first drive gear 64 to the feed-roller shaft 71 when the clutch 81 is in an on state to thereby permit transmission of the rotational force and to cut off the force transmission path when the clutch 81 is in an off state to thereby cut off transmission of the rotational force. Accordingly, when the sheet feed motor 60 is driven and the electromagnetic clutch 81 is in the on state, the feed-roller shaft 71 rotates.

The rotational force transmitted to the feed-roller shaft 71 as described above is further transmitted to a retard-roller drive shaft 72 on a downstream side in the force transmission path. More specifically, the rotational force is transmitted from a first intermediate output gear 65 fitted on the feed-roller shaft 71 to the retard-roller drive shaft 72 via a fourth idle gear 66, a fifth idle gear 67, and a second drive gear 68 which fits on the retard-roller drive shaft 72. According to this construction, the feed-roller shaft 71 and the retard-roller drive shaft 72 rotate in synchronism with each other. In this instance, the rotational force transmitted from the feed-roller shaft 71 that is rotating forward via the plurality of gears causes the retard-roller drive shaft 72 to rotate backward, namely, to rotate in a direction opposite to the rotational direction of the feed-roller shaft 71. The retard roller 26 is equipped with a torque limiter 26*a* having a clutch function for connecting and cutting off the force transmission path from a retard-roller shaft 74 to the retard roller 26. Where only one recording sheet enters between the feed roller 25 and the retard roller 26, the torque limiter 26*a* operates owing to high frictional forces of the feed roller 25 and the retard roller 26 so as to cut off the force transmission path to the retard roller 26. Accordingly, the retard roller 26 rotates following the rotation of the feed roller 25, so that the one recording sheet is fed in the sheet feed direction. On the other hand, where a plurality of recording sheets enter between the feed roller 25 and the retard roller 26, the retard roller 26 rotates such that the recording sheets are sent back in a direction opposite to the sheet feed direction, whereby the uppermost recording sheet 2 is separated from the other sheets and is fed in the sheet feed direction.

The first drive gear 64 is configured to transmit the rotational force to the feed-roller shaft 71 and is in mesh with an external gear 69*a* of a lift gear 69. The lift gear 69 is a ring gear having the external gear 69*a* (external teeth) and an internal gear 69*b* (internal teeth). The first drive gear 64 is rotating all the time by the rotational force received from the sheet feed motor 60 during driving thereof. Accordingly, the lift gear 69 is also rotating all the time during driving of the sheet feed motor 60.

The lift gear 69 is provided with a first rotation shaft 83 as the center of rotation thereof. The first rotation shaft 83 is inserted into a boss portion 82*a* of a cam 82, and the cam 82 is rotatatively supported by the first rotation shaft 83. The cam 82 may be referred to as a lever or a swing lever. The cam 82 includes a first acting portion 82*b* to act on a second arm 85 which will be explained, a second acting portion 82*c* to act on a first arm 86 which will be explained, and a gear support portion 82*d*. The gear support portion 82*d* is provided with a second rotation shaft 84 that extends in parallel with the first rotation shaft 83. A planetary gear 70 having a diameter sufficiently smaller than that of the internal gear 69*b* is supported on the second rotation shaft 84. The planetary gear 70 is disposed between the first rotation shaft 83 and the internal gear 69*b* of the lift gear 69 and is in mesh with the internal gear 69*b*. To the first acting portion 82*b* of the cam 82, a first spring 88 as a biasing member is connected, whereby the cam 82 is biased so as to rotate (rotate forward) about the first rotation shaft 83 as the center of rotation, in a sixth direction, i.e., a direction indicated by an arrow 37B in FIG. 4. On the other hand, for the purpose of restricting rotation (backward rotation) of the cam 82 from a certain rotational phase toward a fifth direction, i.e., a direction indicated by an arrow 37A in FIG. 4, a first stopper 87 is provided so as to be capable of contacting the cam 82.

Here, the movement of the cam 82 will be explained. When the sheet feed motor 60 is being driven, the lift gear 69 is rotating backward about the first rotation shaft 83 by the rotation force received from the sheet feed motor 60. Owing to the rotation of the lift gear 69, the planetary gear 70 that is in mesh with the internal gear 69*b* of the lift gear 69 rotates backward about the second rotation shaft 84 (self rotation). Further, the planetary gear 70 revolves backward around the first rotation shaft 83, owing to a tangential force generated between the lift gear 69 and the planetary gear 70. The backward rotation of the planetary gear 70 causes the cam 82 that supports the planetary gear 70 to rotate in the fifth direction 87A until the cam 82 comes into contact with the first stopper 87. After the cam 82 has come into contact with the first stopper 87, the planetary gear 70 rotates idly and the cam 82 does not rotate anymore in the fifth direction 87*a*.

In the meantime, when the sheet feed motor 60 stops driving, the rotation of the lift gear 69 is also stopped. Accordingly, the tangential force that has caused the planetary gear 70 to be revolving backward about the first rotation shaft 88 does not work. Since the cam 82 is biased by the first spring 88 in the sixth direction 37E, the cam 82 rotates in the sixth direction 37B. In association with this rotation of the cam 82, the planetary gear 70 revolves forward around the first rotation shaft 83 while rotates forward about the second rotation shaft 84.

Figure 2:
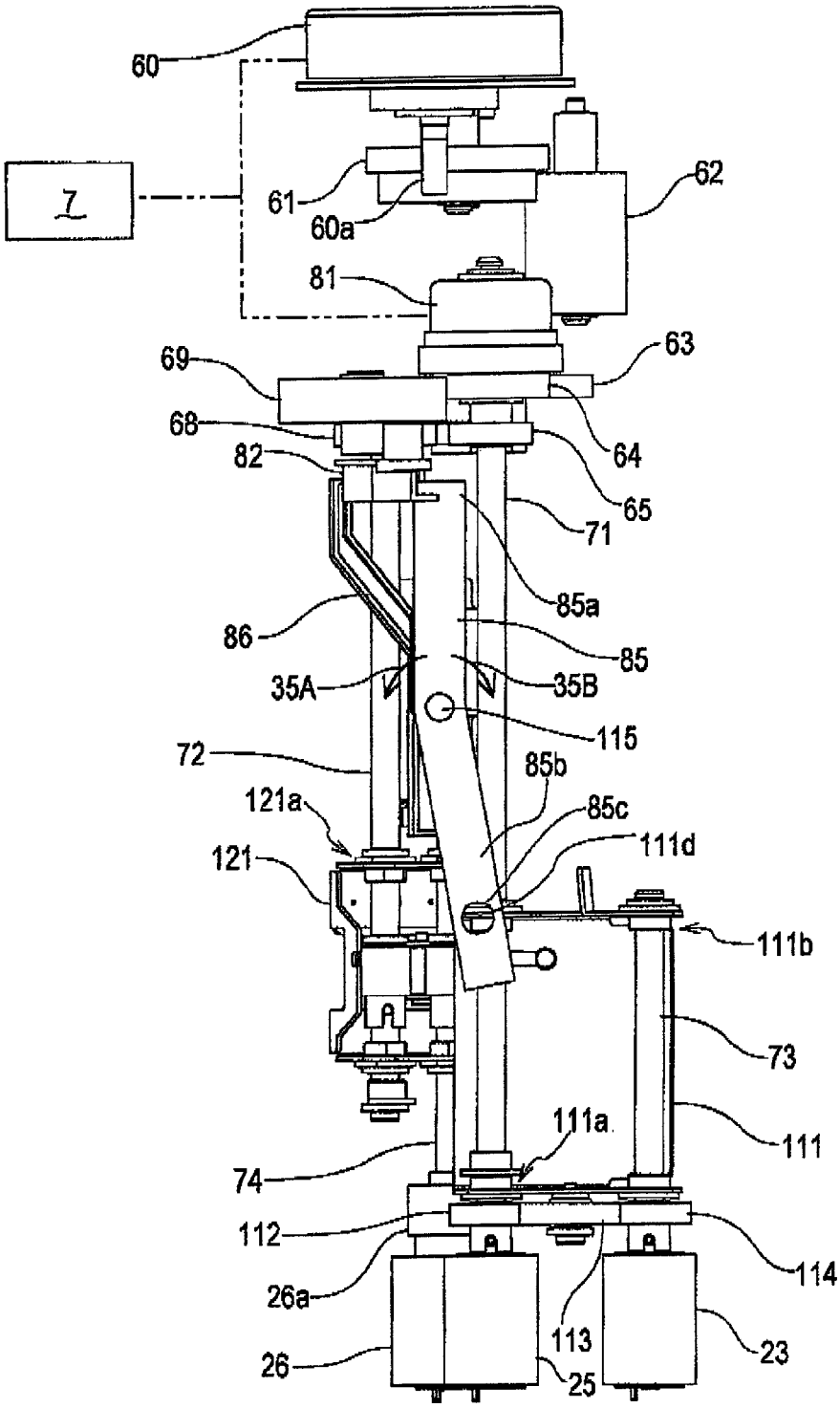
FIG. 2 is a plan view showing a structure of rollers of a sheet feeding portion.
Figure 3:
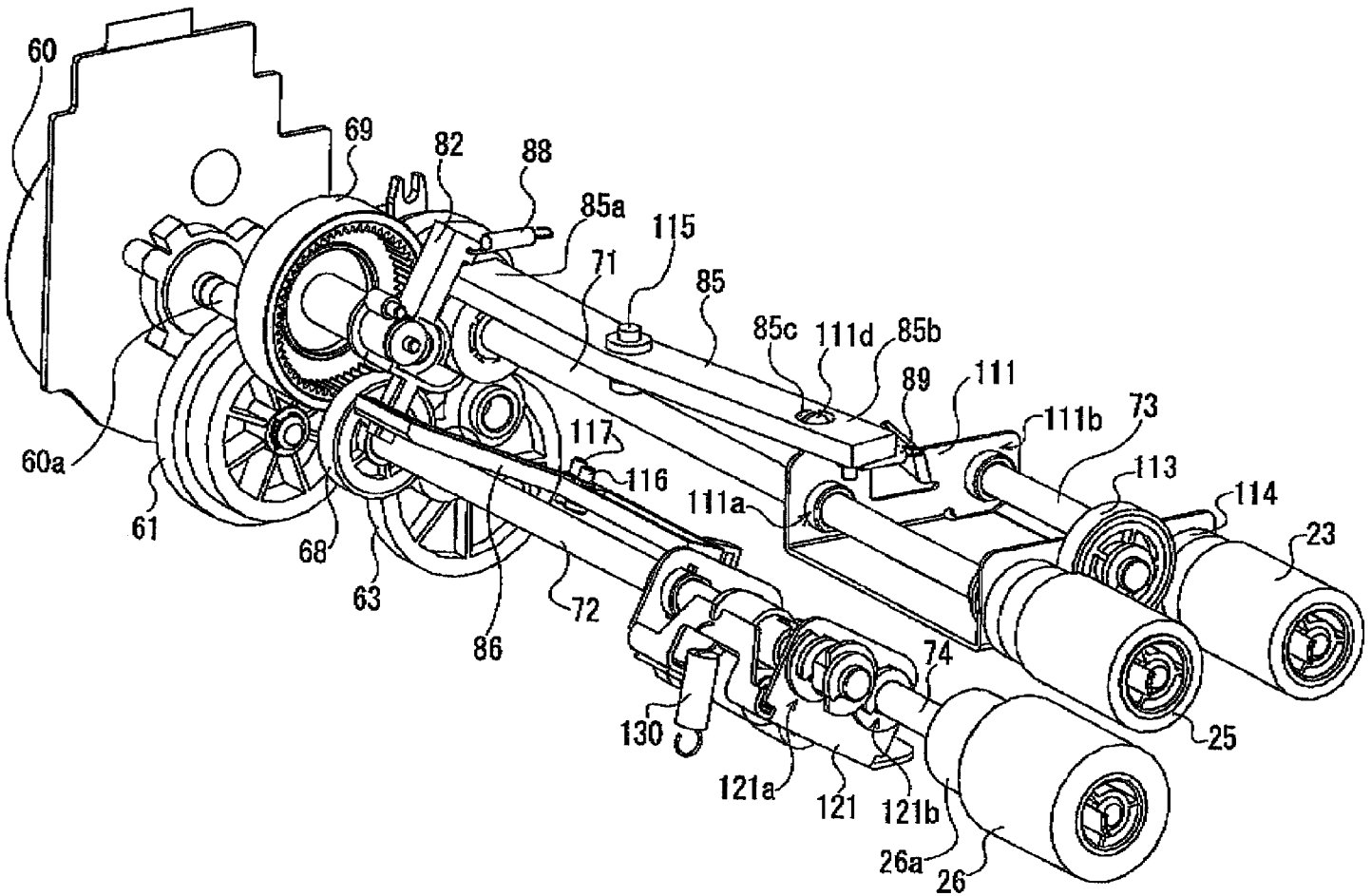
FIG. 3 is a perspective view showing the structure of the rollers of the sheet feed portion.
Figure 4:
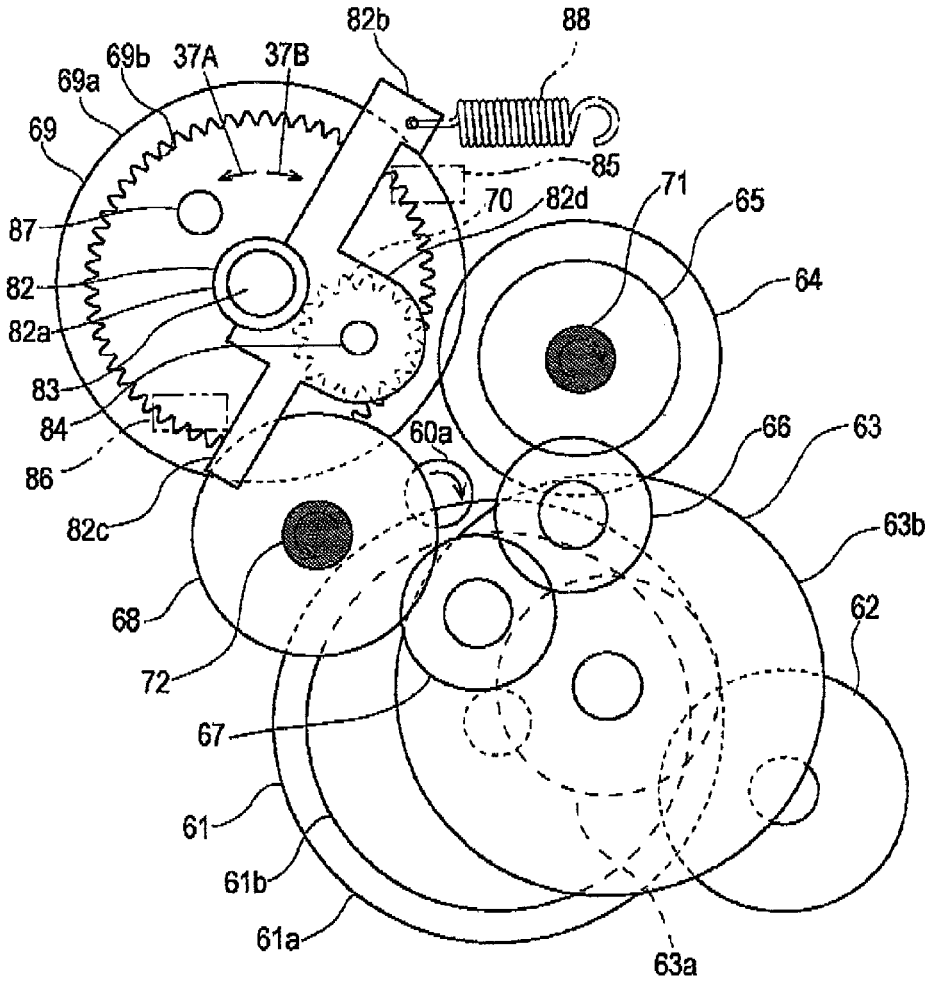
FIG. 4 is a front view showing a force transmission structure from a sheet feed motor to a feed-roller shaft.
Figure 5:
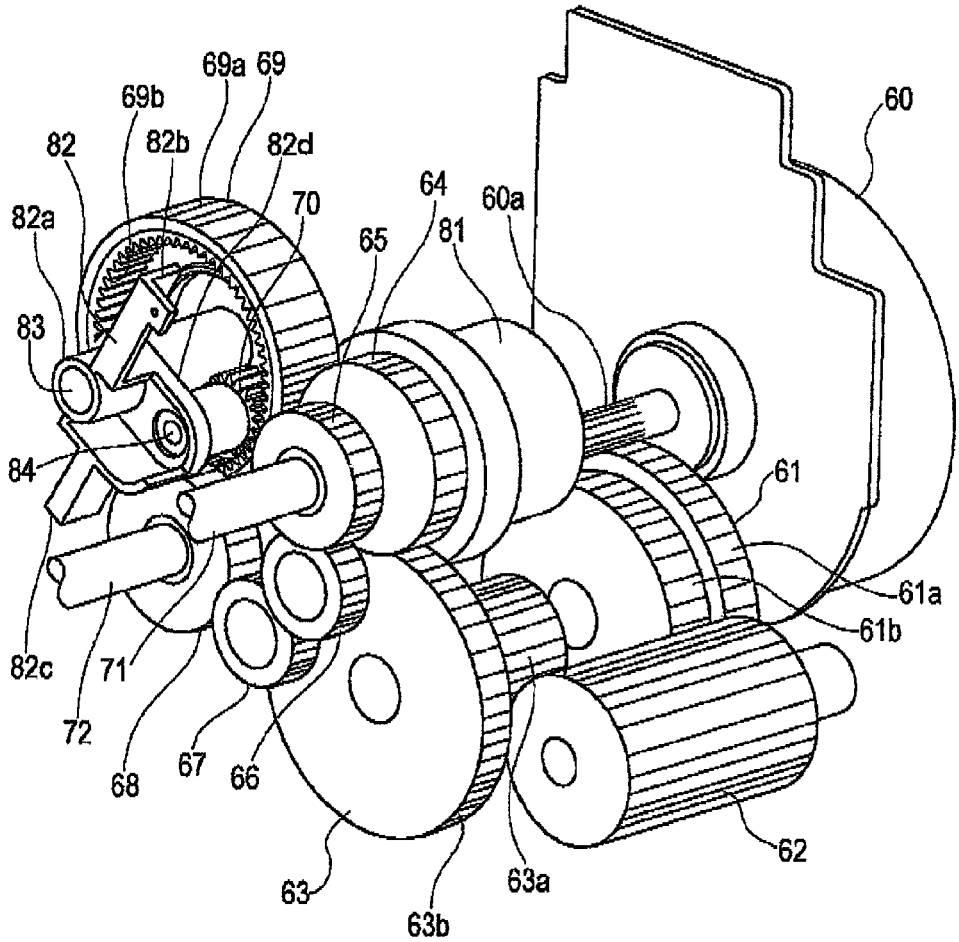
FIG. 5 is a perspective view showing the force transmission structure from the sheet feed motor to the feed-roller shaft.

Referring next to FIGS. 2 and 3, the structures of the feed roller 25 and the pickup roller 23 will be explained. The feed roller 25 is fitted on the feed-roller shaft 71 and is configured to rotate integrally therewith. The feed-roller shaft 71 is rotatably supported by a first support portion 111*a* of a second roller holder 111. The second roller holder 111 includes, in addition to the first support portion 111*a*, a second support portion 111*b* by which a pickup-roller shaft 73 on which the pickup roller 23 is fitted is rotatably supported so as to be in parallel with the feed-roller shaft 71. The second roller holder 111 is disposed so as to be pivotable about the first support portion 111*a*, namely, pivotable about the feed-roller shaft 71, by a stay (not shown) fixed to a housing of the ink-jet recording apparatus 1. According to the arrangement, the second support portion 111*b* and the pickup roller 23 supported by the second support portion 111*b* are movable downward toward the recording sheets 2 on the sheet guide 22 and upward away therefrom.

In the second roller holder 111, the force transmission path from the feed-roller shaft 71 to the pickup-roller shaft 73 is formed. More specifically, a seventh idle gear 118 is provided on the second roller holder 111. The seventh idle gear 113 is in mesh with a feed-roller gear 112 fitted on the feed-roller shaft 71 and a third drive gear 114 fitted on the pickup-roller shaft 73. According to the arrangement, the pickup-roller shaft 73 rotates forward by the rotational force transmitted from the feed-roller shaft 71 that is being rotated forward via the plurality of gears.

On an upper portion of the first support portion 111*a* of the second roller holder 111, there is formed a connection protrusion 111*d* by which the second arm 85 and the second roller holder 111 are moved in an interlocking manner. The second arm 85 is supported, above the feed-roller shaft 71, by a first support pin 115 that extends in a direction substantially orthogonal to the feed-roller shaft 71. The second arm 85 is rotatable about the first support pin 115 in a first direction (indicated by an arrow 35A in FIG. 2) and a second direction (indicated by an arrow 35B in FIG. 2). A first end 85*a* of the second arm 85 is pressed by the first acting portion 82*b* of the cam 82 so as to rotate in the second direction 85B. A second end 85*b* of the second arm 85 which is located on one side of the first support pin 115 remote from the first end 85*a* is formed with a connection hole 85*c* into which the connection protrusion 111*d* of the second roller holder 111 is inserted. According to the arrangement, the second end 85*b* of the second arm 85 and the second roller holder 111 are coupled with each other, thereby interlocking the second arm 85 and the second roller holder 111. That is, when the second arm 85 rotates in the first direction 35A or the second direction 35B, the second roller holder 111 rotates about the feed-roller shaft 71 and the second support portion 111*b* accordingly moves downward or upward. In this regard, the second arm 85 is biased by a second spring 89 connected to the second end 85*b* so as to rotate in the first direction 85A, whereby the second support portion 111*b* of the second roller holder 111 is biased downward.

As described above, a moving mechanism for moving the pickup roller 23 toward and away from the sheet feed guide 22 includes the second roller holder 111 and a second actuator configured to move the second support portion 111*b* of the second roller holder 111 downward and upward. The second actuator includes the second arm 85, the cam 82, the lift gear 69 and the planetary gear 70 configured to rotate the cam 82, and the plurality of gears that constitute the force transmission path from the sheet feed motor 60 to the lift gear 69.

Figure 7A:
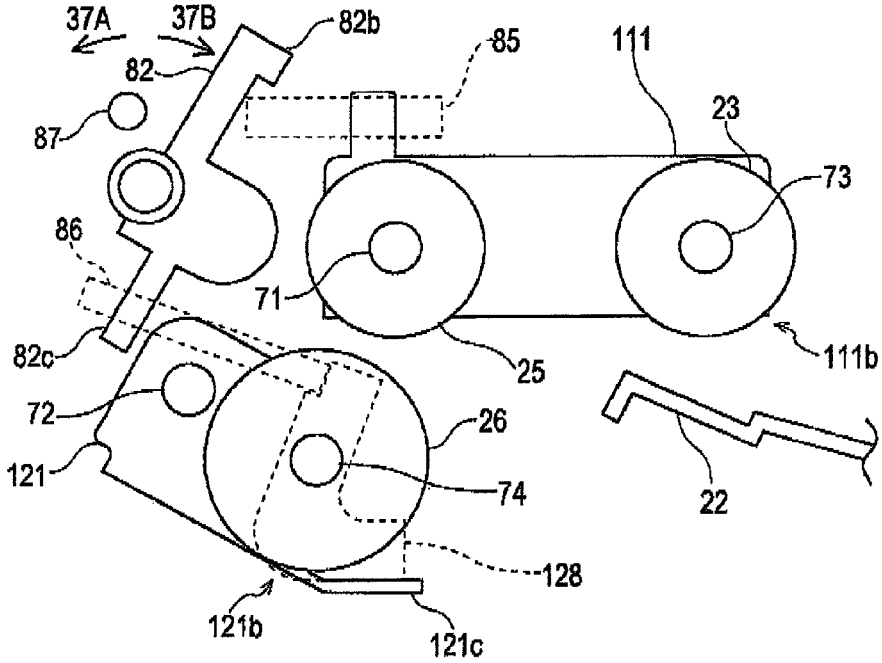
Figure 7B:
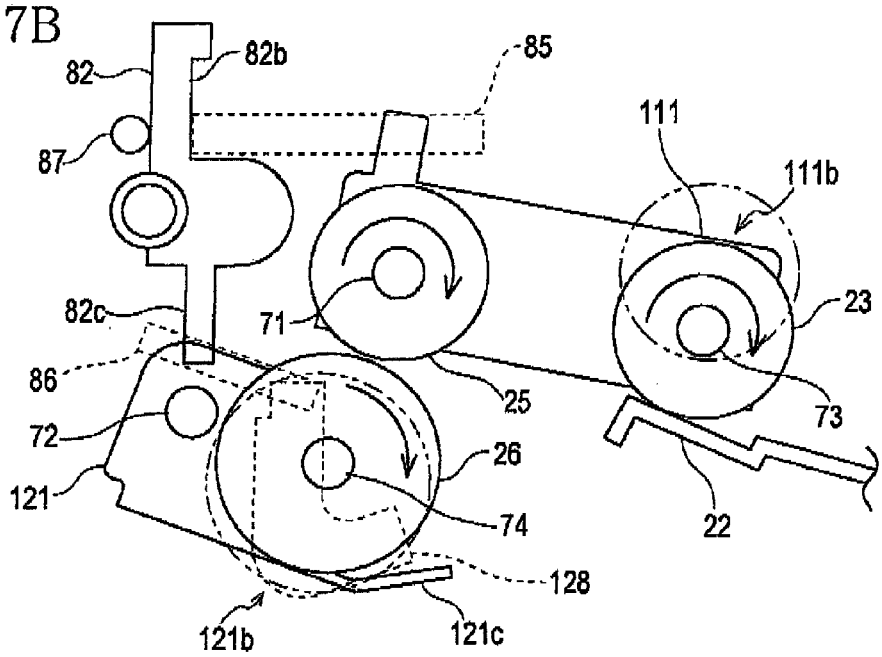
Figure 8:
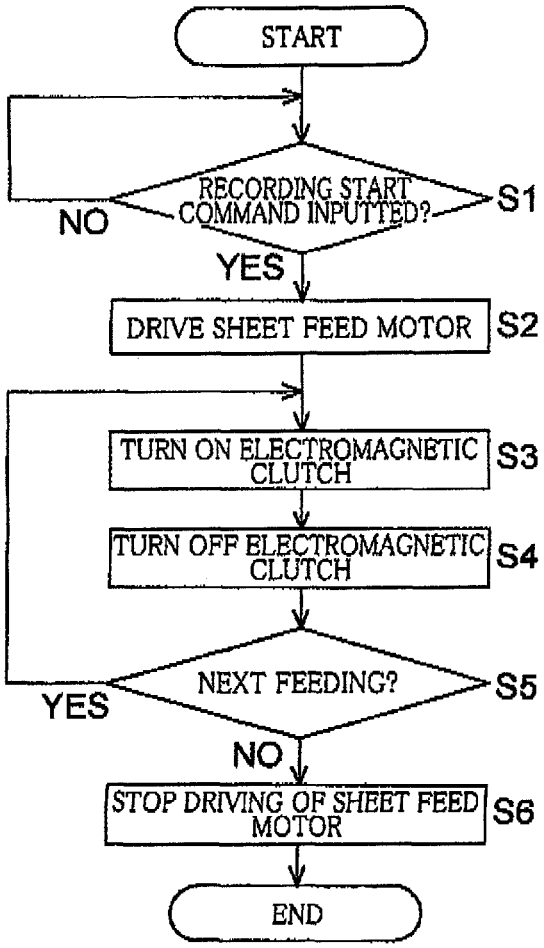
FIG. 8 is a flow chart showing a flow of a drive control of the sheet feeding portion.

Here, there will be explained a movement of the pickup roller 23 and states thereof before and after the movement, with reference to FIG. 7, in addition to FIGS. 2 and 3. When the sheet feed motor 60 is driven and the cam 82 rotates in. the fifth direction 37A, the second arm 85 rotates, by being biased by the second spring 89, in the first direction 35A while following the movement of the cam 82. In conjunction with the movement of the second arm 85, the second support portion 111*b* of the second roller holder 111 moves downward, whereby the pickup roller 23 moves downward so as to come into pressing contact with the uppermost recording sheet 2 on the sheet feed guide 22, as shown in FIG. 7B. On the other hand, when the sheet feed motor 60 stops driving and the cam 82 accordingly rotates in the sixth direction 37B, the second arm 85 is pressed by the cam 82 so as to rotate in the second direction 35B. In conjunction with the movement of the second arm 85, the second support portion 111*b* of the second roller holder 111 moves upward, whereby the pickup roller 23 that has been held in pressing contact with the uppermost recording sheet 2 on the sheet feed guide 22 moves upward so as to separate away therefrom, as shown in FIG. 7A. As explained above, the pickup roller 23 is configured to move away from the sheet feed guide 22 and the recording sheet 2 in dependence on the drive stop of the sheet feed motor 60. In other words, the drive stop of the sheet feed motor 60 triggers the pickup roller 23 to separate away from the sheet feed guide 22 and the recording sheet 2.

Figure 6:
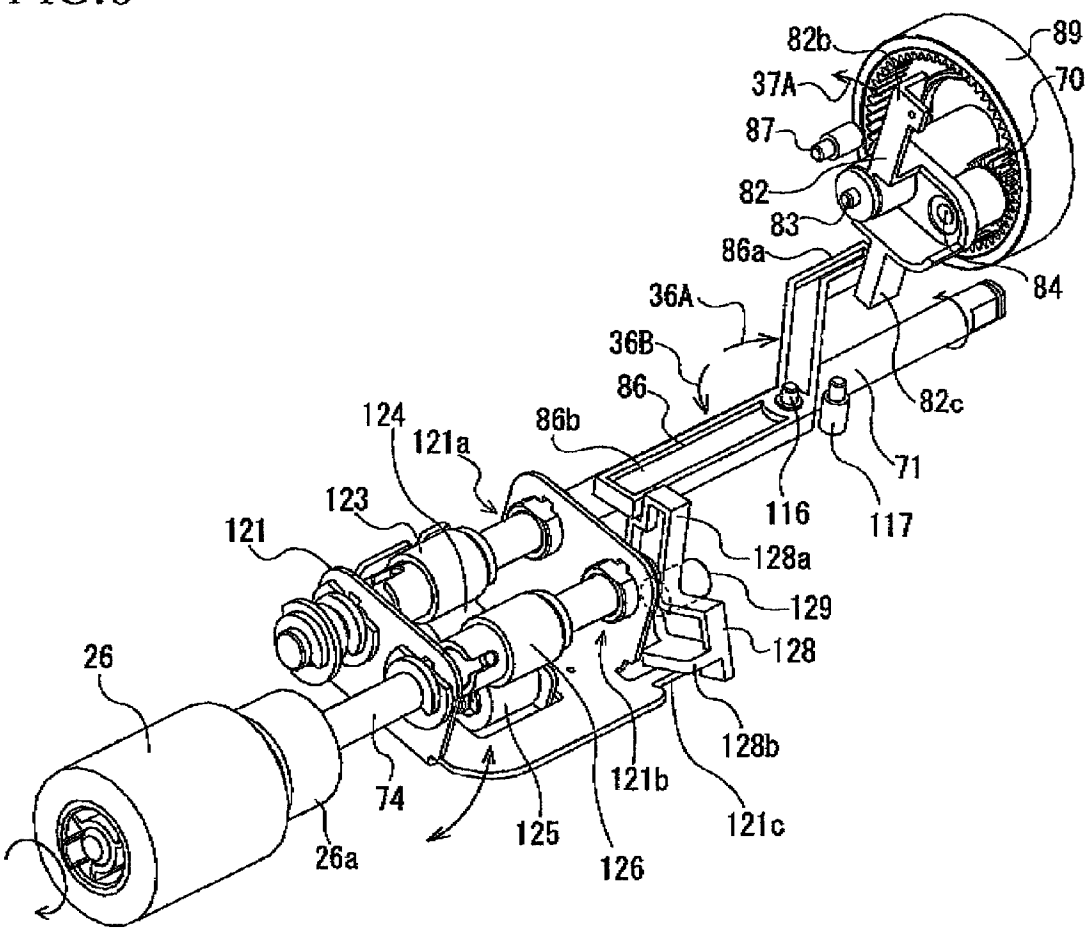
FIG. 6 is a perspective view showing a structure of a retard roller.

Referring next to the perspective view of FIG. 6, the structure of the retard roller 26 will be explained. The retard-roller drive shaft 72 is rotatably supported by a first support portion 121*a* of a first roller holder 121. The first roller holder 121 has a second support portion 121*b*, in addition to the first support portion 121*a*. The second support portion 121*b* rotatably supports the retard-roller shaft 74 on which the retard roller 26 is fitted, so as to be in parallel with the retard-roller drive shaft 72. The first roller holder 121 is disposed so as to be pivotable about the first support portion 121*a*, namely, pivotable about the retard-roller drive shaft 72, by a stay (not shown) fixed to the housing of the ink-jet recording apparatus 1. According to the arrangement, the second support portion 121*b* of the first roller holder 121 is swingable upward and downward about the retard-roller drive shaft 72. Thus, the second support portion 121*b* and the retard roller 26 supported by the second support portion 121*b* are movable upward toward the feed roller 25 and downward away therefrom. Further, the second support portion 121*b* of the first roller holder 121 is biased so as to move upward by a third spring 130 connected to the first roller holder 121 on the side of the first support portion 121*a*.

In the first roller holder 121, the force transmission path from the retard-roller drive shaft 72 to the retard-roller shaft 74 is formed. More specifically, the first roller holder 121 has an eighth idle gear 124 and a ninth idle gear 125 which are in mesh with each other. The eighth idle gear 124 is in mesh with a second intermediate output gear 123 which is fitted on the retard-roller drive shaft 72 while the ninth idle gear 125 is in mesh with a third drive gear 126 which is fitted on the retard-roller shaft 74. According to the arrangement, the retard-roller shaft 74 rotates backward by the rotational force transmitted from the retard-roller drive shaft 72 that is being rotated backward via the plurality of gears.

The first roller holder 121 has a to-be-acted portion 121*c* at a position thereof opposite to the first support potion 121*a* as the center of the rotation. The to-be-acted portion 121*c* is in contact with a pressure lever 128 which interlocks with the first arm 86. The pressure lever 128 is generally L-shaped and is supported by a second support pin 129 that extends in parallel with the retard-roller drive shaft 72. A first end 128*a* of the pressure lever 128 is in contact with the first arm 86 while a second end 128*b* thereof is in contact with the to-be-acted portion 121*c* of the first roller holder 121.

The first arm 86 is rotatably supported, above the retard-roller drive shaft 72, by a third support pin 116 that extends in a direction substantially orthogonal to the retard-roller drive shaft 72. The first arm 86 is rotatable about the third support pin 116 in a third direction (indicated by an arrow 36A in FIG. 6) and a fourth direction (indicated by an arrow 36B in FIG. 6). A first end 86*a* of the first arm 86 is in contact with the second acting portion 82*c* of the cam 82. A second end 86*b* of the first arm 86 which is located on one side of the third support pin 116 remote from the first end 86*a* is in contact with the first end 128*a* of the pressure lever 128. Since the second support portion 121*b* of the first roller holder 121 is biased upward by the third spring 130 (FIG. 3), the first arm 86 is biased so as to rotate in the third direction 36A through the pressure lever 128 that is in contact with the first roller holder 121. Further, there is provided a second stopper 117 configured to restrict rotation of the first arm 86 further in the third direction 36A from a certain rotational phase.

As described above, a moving mechanism for moving the retard roller 26 toward and away from the feed roller 26 includes the first roller holder 121 and a first actuator configured to move the second support portion 121*b* of the first roller holder 121 upward and downward. The first actuator includes the pressure lever 128, the first arm 86, the cam 82, the lift gear 69 and the planetary gear 70 configured to rotate the cam 82, and the plurality of gears that constitute the force transmission path from the sheet feed motor 60 to the lift gear 69.

Here, there will be explained a movement of the retard roller 25 and states thereof before and after the movement, with reference to FIG. 7, in addition to FIG. 6. When the sheet feed motor 60 is driven and the cam 82 rotates in the fifth direction 37A, the first arm 86 rotates in the third direction 36A while following the movement of the cam 82 until the first arm 86 comes into contact with the second stopper 117. In conjunction with the movement of the first arm 86, the pressure lever 128 rotates and the second support portion 121*b* of the first roller holder 121 moves upward, whereby the retard roller 26 moves upward so as to come into pressing contact with the feed roller 25, as shown in FIG. 7B. On the other hand, when the sheet feed motor 60 stops driving and the cam 82 accordingly moves in the sixth direction 37B, the first arm 86 is pressed by the cam 82 so as to rotate in the fourth direction 36B. In conjunction with the movement of the first arm 86, the pressure lever 128 rotates and the second support portion 121*b* of the first roller holder 121 moves downward, whereby the retard roller 26 that has been held in pressing contact with the feed roller 25 moves downward so as to separate away therefrom, as shown in FIG. 7A. As explained above, the retard roller 26 is configured to move away from the feed roller 25 in dependence on the drive stop of the sheet feed motor 60. In other words, the drive stop of the sheet feed motor 60 triggers the retard roller 26 to separate away from the feed roller 25.

Next, there will be explained one example of a drive control of the sheet feeding portion 4 constructed as described above with reference to the flow chart showing a flow of the drive control. As mentioned above, the sheet feeding portion 4 includes the plurality of rollers configured to be rotatably driven. The rollers are configured to be driven by one sheet feed motor 60 which operates under a control of the controller 7.

When a recording start button of the ink-jet recording apparatus 1 is pushed and accordingly a recording start command is inputted (step S1), the controller 7 controls the sheet feed motor 60 to be driven (step S2). When the sheet feed motor 60 is driven, the retard roller 26 is brought into pressing contact with the feed roller 25 and the pickup roller 23 is brought into pressing contact with the uppermost sheet 2 on the sheet feed guide 22, as shown in FIG. 7B. It is noted, here, that the these rollers 23, 25, 26, are not yet rotated. Subsequently, the controller 7 controls the electromagnetic clutch 81 to be placed in the on state (step S3), whereby the rotational force is transmitted to the feed-roller shaft 71, so that the feed roller 25, the retard roller 26, and the pickup roller 23 are rotated. Owing to the rotations of the rollers 23, 25, 26, the uppermost sheet 2 on the sheet cassette 21 is sent to the sheet feed path 31 and is fed therethrough in the sheet feed direction. When the feeding of one sheet is completed, the controller 7 controls the electromagnetic clutch 81 to be placed in the off state (step S4). The switching of the electromagnetic clutch 81 between on and off is repeated for a number of times corresponding to the number of the recording sheets 2 to be recorded in the recording portion 5. When the recording is completed (step S5), the controller 7 controls the sheet feed motor 60 to stop driving (step S6). When the sheet feed motor 60 stops driving, the retard roller 26 is moved away from the feed roller 25 and the pickup roller 23 is moved away from the uppermost recording sheet 2 on the sheet feed guide 22, as shown in FIG. 7A.

In the sheet feeding portion 4 according to the present embodiment, the drive of the sheet feed motor 60, i.e., the initiation of the drive of the sheet feed motor 60, triggers the retard roller 26 to move toward the fixedly positioned feed roller 25 so as to come into pressing contact therewith and also triggers the pickup roller 23 to move toward the sheet feed guide 22 so as to come into pressing contact with the sheet guide 22, namely, so as to come into pressing contact with the sheet guide 22 via the recording sheets 2. Further, owing to the rotations of these rollers, the recording sheet 2 is fed along the sheet feed path 31 in the sheet feed direction. Moreover, in the sheet feeding portion 4 according to the present embodiment, the drive stop of the sheet feed motor 60 triggers the retard roller 26 to move away from the feed roller 25 and also triggers the pickup roller 23 to move away from the sheet feed guide 22. Accordingly, the recording sheet 2 does not receive any pressure between the feed roller 25 and the retard roller 26 and between the sheet feed guide 22 and the pickup roller 23. When the sheet cassette 21 is removed from the main body of the inkjet recording apparatus 1, the rollers 23, 25, 26 for conveying the recording sheet 2 are not rotating and the sheet feed motor 60 is not being driven. In other words, when the sheet cassette 21 is removed from the main body of the ink-jet recording apparatus 1, the recording sheet 2 is not receiving any pressure from the rollers 23, 25 26. Accordingly, the sheet cassette 21 can be detached from the main body without tearing or jamming of the recording sheet 2. Further, when the recording sheet 2 jammed in the sheet feed path 31 is removed, the rollers 23, 25, 26 for conveying the recording sheet 2 are not rotating and the sheet feed motor 60 is not being driven. In other words, when the recording sheet 2 is removed from the conveyance path 3 by opening a housing portion of the apparatus 1 other than the sheet cassette 21, such as a side panel of the housing, the recording sheet 2 is not receiving any pressure from the rollers 23, 25 26. Accordingly, the recording sheet 2 can be easily removed from the conveyance path 8.

Moreover, when the sheet feed motor 60 is being driven, the pickup roller 23 and the sheet guide 22 are kept in pressing contact with each other, namely, the pickup roller 23 and the sheet feed guide 22 are kept in pressing contact with each other via the recording sheets 2, and the feed roller 25 and the retard roller 26 are kept in pressing contact with each other, irrespective of whether the rollers 23, 25, 26 are rotating or not. That is, the pressing contact and the releasing of the pressing contact are not repeated for every one cycle of the sheet feeding. Therefore, it is possible to prevent multiple feeding of the recording sheets 2 due to an electrostatic force.

In the illustrated embodiment, the mechanism of moving the pickup roller 23 toward and away from the sheet feed guide 22 and the mechanism of moving the retard roller 26 toward and away from the feed roller 25 are both constituted in a mechanical fashion. In other words, the movements of the pickup roller 23 and the retard roller 26 do not require solenoids and any special control, contributing to downsizing of the main body of the ink-jet apparatus 1 and reduction of the production cost. It is noted, however, that one example of the moving mechanism of the pickup roller 23 and one example of the moving mechanism of the retard roller 26 are illustrated above. The moving mechanisms may be otherwise embodied.

The sheet feeding portion 4 according to the illustrated embodiment is configured such that the retard roller 26 moves toward and away from the fixedly positioned feed roller 25 and such that the pickup roller 23 moves toward and away from the fixedly positioned sheet feed guide 22. The sheet feeding portion 4 may be otherwise constructed. For instance, the feed roller 25 may move toward and away from the fixedly positioned retard roller 26 and the sheet feed guide 22 may move toward and away from the fixedly positioned pickup roller 23. Further, the pickup roller 23 may move toward and away from the sheet feed guide 22 in dependence on the drive and the drive stop of the sheet feed motor 60 while the retard roller 26 may move toward and away from the fixedly positioned feed roller 25 according to a different technique.

The sheet feeding portion 4 according to the illustrated embodiment employs the retard roller 26 which is one sort of a separation roller, as a pressure body to come into pressing contact with the feed roller 25. The pressure body is not limited to the retard roller 26. In place of the retard roller 26, there may be employed, as the pressure body, a separation roller such as a reverse roller or a reverse belt, or a frictional separation plate configured to come into pressing contact with the feed roller 25. These are configured to be movable toward and away from the feed roller 25, like the retard roller 26 indicated above. Particularly where the reverse roller or the reverse belt is employed as the pressure body, those are configured to send the recording sheet 2, which is held by and between the feed roller 25 and the pressure body, back in a direction opposite to the sheet feed direction, like the retard roller indicated above.

As the recording apparatus equipped with the sheet feeding device (the sheet feeding portion 4) according to the embodiment, the ink-jet recording apparatus of the line type has been explained above by way of one example. The recording apparatus equipped with the sheet feeding device is not limited to the ink-jet recording apparatus, but may be any kind of recording apparatus equipped with a sheet cassette, such as a facsimile machine, a copying machine, or a printer. In other words, the invention is applicable to the recording apparatus equipped with the sheet feeding device having the sheet cassette removably attached to the main body of the apparatus.

What is claimed is:

1. A sheet feeding device, comprising:

a sheet cassette configured to accommodate sheets;

a conveyance path through which each of the sheets accommodated in the sheet cassette is conveyed;

a rotation roller provided at one of a start point and a vicinity thereof in the conveyance path;

a motor configured to rotatably drive the rotation roller;

a pressure body configured to come into pressing contact with the rotation roller via the sheet; and a moving mechanism configured to separate the rotation roller and the pressure body, which are in pressing contact with each other, away from each other when driving of the motor stops and configured to bring the rotation roller and the pressure body, which are away from each other, into pressing contact with each other when driving of the motor is initiated, wherein the moving mechanism includes: a first holder configured to support the pressure body; and a first actuator configured to move the first holder so as to bring a portion of the first holder, at which the pressure body is supported, close to the rotation roller when the motor is driven and to move the first holder so as to separate the portion of the first holder, at which the pressure body is supported, away from the rotation roller when the motor stops driving, wherein the first actuator includes: a first arm configured to act on the first holder so as to move the first holder; a first cam configured to act on the first arm; and a first force-transmitting portion configured to transmit a force from the motor to the first cam, and wherein the first force transmitting portion includes: a ring gear having internal teeth and external teeth which are directly or indirectly in mesh with a gear fitted on an output shaft of the motor; and a gear which is directly or indirectly provided on the first cam so as to be in mesh with the internal teeth of the ring gear.

2. The sheet feeding device according to claim 1, wherein the pressure body is a separation roller which is provided at the vicinity of the start point of the conveyance path and which is configured such that, where a plurality of sheets are supplied from the sheet cassette at a time, one of the sheets is separated from the other of the sheets.

3. The sheet feeding device according to claim 1, wherein the rotation roller is a feed roller which is provided at the vicinity of the start point of the conveyance path and which is configured to feed each of the sheets sent from the sheet cassette along the conveyance path.

4. The sheet feeding device according to claim 1, wherein the rotation roller is a pickup roller which is provided at the start point of the conveyance path and which is configured to send each of the sheets from the sheet cassette to the conveyance path while the pressure body is a guide of the sheet cassette disposed so as to be opposed to the pickup roller.

5. A recording apparatus, comprising:

the sheet feeding device defined in claim 1; and at least one recording head configured to eject ink toward each of the sheets fed by the sheet feeding device.

6. A sheet feeding device comprising:

a sheet cassette configured to accommodate sheets;

a conveyance path through which each of the sheets accommodated in the sheet cassette is conveyed;

a rotation roller provided at one of a start point and a vicinity thereof in the conveyance path;

a motor configured to rotatably drive the rotation roller;

a pressure body configured to come into pressing contact with the rotation roller via the sheet; and a moving mechanism configured to separate the rotation roller and the pressure body, which are in pressing contact with each other, away from each other when driving of the motor stops and configured to bring the rotation roller and the pressure body, which are away from each other, into pressing contact with each other when driving of the motor is initiated, wherein the moving mechanism includes: a second holder configured to support the rotation roller; and a second actuator configured to move the second holder so as to bring a portion of the second holder, at which the rotation roller is supported, close to the pressure body when the motor is driven and to move the second holder so as to separate the portion of the second holder, at which the rotation roller is supported, away from the pressure body when the motor stops driving.

7. The sheet feeding device according to claim 6, wherein the second actuator includes:

a second arm configured to act on the second holder so as to move the second holder;

a second cam configured to act on the second arm; and a second force-transmitting portion configured to transmit a force from the motor to the second cam.

8. The sheet feeding device according to claim 7, wherein the second force transmitting portion includes:

a ring gear having internal teeth and external teeth which are directly or indirectly in mesh with a gear fitted on an output shaft of the motor; and a gear which is directly or indirectly provided on the second cam so as to be in mesh with the internal teeth of the ring gear.

9. The sheet feeding device according to claim 6, wherein the pressure body is a separation roller which is provided at the vicinity of the start point of the conveyance path and which is configured such that, where a plurality of sheets are supplied from the sheet cassette at a time, one of the sheets is separated from the other of the sheets.

10. The sheet feeding device according to claim 6, wherein the rotation roller is a feed roller which is provided at the vicinity of the start point of the conveyance path and which is configured to feed each of the sheets sent from the sheet cassette along the conveyance path.

11. The sheet feeding device according to claim 6, wherein the rotation roller is a pickup roller which is provided at the start point of the conveyance path and which is configured to send each of the sheets from the sheet cassette to the conveyance path while the pressure body is a guide of the sheet cassette disposed so as to be opposed to the pickup roller.

12. A recording apparatus, comprising:

the sheet feeding device defined in claim 6; and at least one recording head configured to eject ink toward each of the sheets fed by the sheet feeding device.

13. A sheet feeding device comprising:

a sheet cassette configured to accommodate sheets;

a conveyance path through which each of the sheets accommodated in the sheet cassette is conveyed;

a rotation roller provided at one of a start point and a vicinity thereof in the conveyance path;

a motor configured to rotatably drive the rotation roller;

a pressure body configured to come into pressing contact with the rotation roller via the sheet; and a moving mechanism configured to separate the rotation roller and the pressure body, which are in pressing contact with each other, away from each other when driving of the motor stops and configured to bring the rotation roller and the pressure body, which are away from each other, into pressing contact with each other when driving of the motor is initiated, wherein the moving mechanism includes: a first holder configured to support the pressure body; and a first actuator configured to move the first holder so as to bring a portion of the first holder, at which the pressure body is supported, close to the rotation roller when the motor is driven and to move the first holder so as to separate the portion of the first holder, at which the pressure body is supported, away from the rotation roller when the motor stops driving, wherein the first actuator includes:

a first arm configured to act on the first holder so as to move the first holder;

a first cam configured to rotate about a rotation shaft and to act on the first arm;

a biasing member configured to bias the first cam in a direction in which the first cam is configured to rotate forward about the rotation shaft;

a first force-transmitting portion configured to transmit a force from the motor to the first cam, wherein the force is sufficient to permit the first cam to rotate backward about the rotation shaft;

a first stopper configured to restrict backward rotation of the first cam by contacting the first cam when the first cam is being rotated backward, and wherein the first force-transmitting portion comprises:

a ring gear configured to rotate about the rotation shaft and comprising (a) internal teeth that are provided on an inner circumference of the ring gear and (b) external teeth that are provided on an outer circumference of the ring gear, the internal teeth and the external teeth of the ring gear configured to directly or indirectly mesh with a gear fitted on an output shaft of the motor; and a planetary gear configured to mesh with the internal teeth of the ring gear and configured to rotate with respect to the first cam, wherein, when the motor is driven, the ring gear is configured to rotate backward about the rotation shaft;

the planetary gear and the first cam are configured to rotate backward about the rotation shaft due to a tangential force generated between the ring gear and the planetary gear and to continue to rotate backward about the rotation shaft until the first cam comes into contact with the first stopper; and the first arm is configured to move when the first cam rotates backward about the rotation shaft, such that the first actuator is configured to move the first holder using the first arm to move a portion of the first holder close to the rotation roller, the portion of the first holder being a portion at which the pressure body is supported, and wherein, when the motor stops, the ring gear is configured to stop backward rotation about the rotation shaft;

the planetary gear and the first cam are configured to rotate forward about the rotation shaft due to a biasing force of the biasing member; and the first arm is configured to move when the first cam rotates forward about the rotation shaft, such that the first actuator is configured to move the first holder using the first arm to separate the portion of the first holder from the rotation roller.

14. The sheet feeding device according to claim 13, wherein the pressure body is a separation roller which is provided at the vicinity of the start point of the conveyance path and which is configured such that, where a plurality of sheets are supplied from the sheet cassette at a time, one of the sheets is separated from the other of the sheets.

15. The sheet feeding device according to claim 13, wherein the rotation roller is a feed roller which is provided at the vicinity of the start point of the conveyance path and which is configured to feed each of the sheets sent from the sheet cassette along the conveyance path.

16. The sheet feeding device according to claim 13, wherein the rotation roller is a pickup roller which is provided at the start point of the conveyance path and which is configured to send each of the sheets from the sheet cassette to the conveyance path while the pressure body is a guide of the sheet cassette disposed so as to be opposed to the pickup roller.

17. A recording apparatus, comprising:

the sheet feeding device defined in claim 13; and at least one recording head configured to eject ink toward each of the sheets fed by the sheet feeding device.

* * * * *